United States Patent [19]

Cull

[11] 4,040,222

[45] Aug. 9, 1977

[54] CAVITY WALL AND METHOD USING ADJUSTABLE SPACING DEVICES

[75] Inventor: Alan Sidney Cull, Cammeray, Australia

[73] Assignee: Civic & Civic PTY Limited, Sydney, Australia

[21] Appl. No.: 687,607

[22] Filed: May 18, 1976

[30] Foreign Application Priority Data

May 20, 1975 Australia ..... 1666/75

[51] Int. Cl.[2] ..... E04B 2/30

[52] U.S. Cl. ..... 52/365; 52/303; 52/508; 52/513; 52/678; 52/713; 52/749

[58] Field of Search ..... 52/365, 345, 568, 713, 52/378, 379, 513, 508, 122, 126, 303

[56] References Cited

U.S. PATENT DOCUMENTS

| | | | |
|---|---|---|---|
| 954,814 | 4/1910 | Lawrence | 52/378 |
| 1,503,148 | 7/1924 | Bernstrom | 52/365 |
| 1,617,555 | 2/1927 | Vallentin | 52/345 X |
| 2,049,907 | 8/1936 | Hess | 52/508 X |
| 3,266,202 | 8/1966 | Furer | 52/710 X |
| 3,309,830 | 3/1967 | Fitzgerald | 52/513 |
| 3,316,680 | 5/1967 | Chrastek | 52/126 |
| 3,318,057 | 5/1967 | Norsworthy | 52/126 |
| 3,341,998 | 9/1967 | Lucas | 52/713 X |
| 3,786,605 | 1/1974 | Winfrey | 52/378 X |

FOREIGN PATENT DOCUMENTS

| | | | |
|---|---|---|---|
| 1,568,176 | 4/1969 | France | 52/126 |

*Primary Examiner*—Alfred C. Perham

[57] ABSTRACT

A wall having an outer structural component of masonry units which are provided with dovetail slots in their inner faces. A fixing device is provided which has a tongue at one end of a screw threaded rod and an adjustable cap at the other. The tongue is inserted and fixed into the dovetail slot and the cap adjusted by screwing on the rod. Caps of the various fixing devices are aligned in a vertical plane and an inner skin of plaster board or the like secured by screwing to the aligned caps. Transfer of moisture from the porous masonry wall to the inner skin is prevented by providing sufficient screw threading on the rod to allow a number of turns of the thread to remain exposed when the cap is screwed to its innermost position.

8 Claims, 4 Drawing Figures

CAVITY WALL AND METHOD USING ADJUSTABLE SPACING DEVICES

This invention relates to walls and, more particularly, to methods of constructing walls having external masonry and an inner skin lining, there being a cavity between the two components.

In the art of building construction, mansonry walls have the advantages of being permanent, popular with the market, structural, and extremely flexible in terms of building design. They have, however, a major disadvantage in that they are porous.

Whereas attempts to prevent water penetration from the ground and at openings by means of a non-porous lining or flashing have proven successful, attempts to prevent water penetration through outer brickwork to the inner surface by use of impervious linings have, with time, failed.

The most effective method of preventing penetration has been the building-in of an air-cavity across which water cannot pass. Initially, walls on each side of the cavity were made of masonry, the accepted treatment of the internal surface being applied plaster to provide a smooth surface. Later, the internal skin came to be replaced with a timber stud wall, with a sheet-lining applied to it to provide the acceptable smooth finish. This "brick veneer" method still achieved water-protection and had appreciable savings in material and labour costs and construction time over fullbrick which advantages remain today.

However, both these systems had the inefficiency of two structural walls where only one should be necessary.

A more recent innovation, known commonly as Brick and Veneer Laminate System, eliminates one of the structural walls. However, it relies upon an impervious membrane for complete water-isolation. The inside skin is fixed by means of an adhesive block; such a fixing is considered too dependent upon the cleanness of surfaces and the durability of the chemical composition of the glue to be considered as reliable as a purely mechanical fixing. The adhesive block is of a standard width; either fixing of these adhesive blocks made to masonry blocks of usual tolerances in size and laying would be ineffective, or the irregularities in the internal surface of the masonry wall would be reflected in an irregularly aligned internal surface.

It is an object of this invention to provide a method of constructing a wall, which wall ameliorates disadvantages of conventional masonry walls.

Consequently, this invention in one broad form provides a method of constructing a cavity wall wherein the external masonry wall is the load-bearing element and the inner skin is a non-loading bearing membrane, comprising the steps of erecting said masonry wall, securing a plurality of spacing devices, each having a fixing surface, to the internal surface of said masonry wall, aligning in a predetermined plane said fixing surfaces, and thence fixing said inner skin to said fixing surfaces.

The invention further provides a wall constructed according to the above specified method.

It is preferred that the spacing means referred to above comprises a plastics device having a screw threaded rod with a screwable cap disposed on one end thereof and a tongue member disposed on the other end. The masonry units are preferably moulded with a dovetail slot incorporated in the side thereof to be disposed on the cavity side of the wall. The tongue of the spacing device is inserted into this groove and rotated so as to be rigidly fixed therein. The screwable cap may then be adjusted on the screw threaded rod so that the fixing surface of this cap is aligned in a vertical plane with fixing surfaces of other neighbouring caps. The inner skin is then affixed to the said fixing surfaces, which are preferably circular and flat, as by conventional screwing.

In cases where the lining material requires continuous support at joints, such support can be readily provided by bridging the disc attachments with a continuous light metal channel or similar member. In this case, the even vertical plane required is retained by adjustment of the relevant discs prior to attachment of the channel member such that the face of the channel is in the same plane as the remainder of the discs.

Preferred forms of the invention are illustrated with reference to the accompanying drawings in which.

Masonry wall 1 is composed of masonry units 2 which are manufactured by casting or extrusion and are of commercially acceptable brick or block dimensions.

The masonry units are manufactured to allow for fixing of the plastic fixing device 6 and 10. In the process of casting or extruding, dovetail grooves 3 are formed integrally in the reverse or normally inner face of said units 2.

Figure 1:
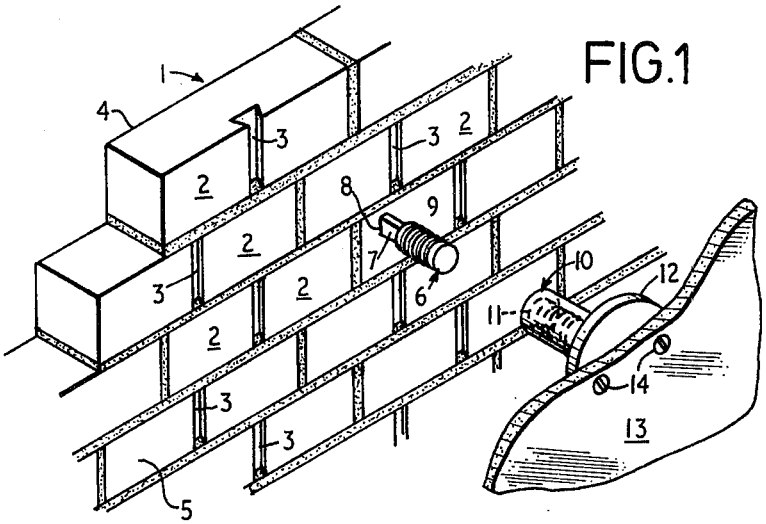
FIG. 1 is an exploded perspective of an external wall, a fixing device and internal wall sheet.
Figure 2:
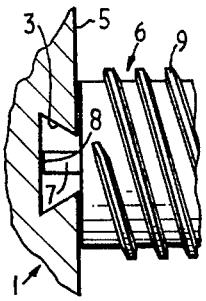
FIG. 2 is a fragmentary view of one groove in an external wall unit with portion of the fixing device inserted therein prior to locking.
Figure 3:
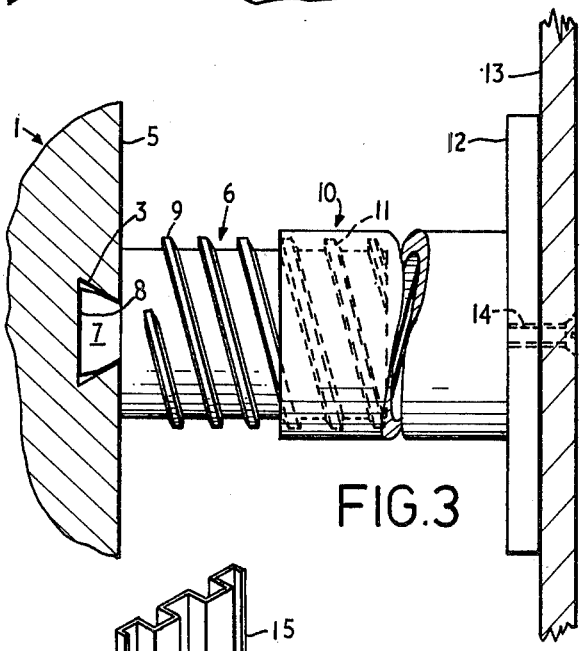
FIG. 3 is a similar view to FIG. 2 showing a fixing device locked to the external wall and an internal wall secured to the fixing device.

The male portion 6 of the plastic fixing device is adapted to be connected to the masonry unit 2 by placing the rectangular nose 7 into the groove 3 such that the face 8 is hard against the inside surface of the masonry wall 1 as illustrated in FIG. 2. The plastic device is then rotated up to 90° until a positive locked connection is provided along the long axis of the rectangular nose-piece 7 as shown in FIG. 3.

The female member 10 of the plastic device can then be adjusted by means of screwing in or out on the threads 9 and 11 so that a flange 12 associated with the member 10 and adapted to secure the internal lining 13 is truly aligned to a predetermined line.

It should be noted that independent alignment of the internal lining 13 is necessary because the masonry wall 1 is aligned during construction to its external face 4 whereas the plastic device is fixed to a potentially irregular internal face 5.

The width of the cavity between the walls 1 and 13 should be such that several rotations of the male thread 9 are left exposed on the member 6, providing drips to prevent water from reaching the female portion of the device 10 and the inner lining 13 by capillary or other type of flow.

The inner lining 13 is connected directly to the plastic device by screws 14 secured to the flange 12 of the member 10 using standard screws recommended by manufacturers of the selected lining material 13.

Figure 4:
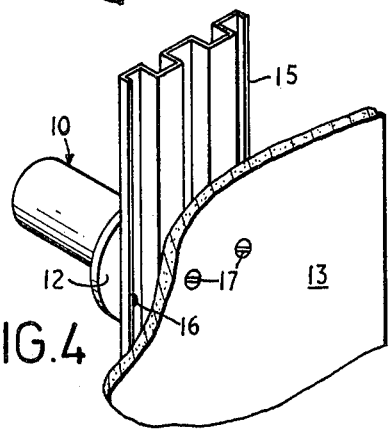
FIG. 4 is a fragmentary perspective view of an alternative form of wall construction wherein a batten member is interposed between the fixing device and the internal wall sheet.

In an alternative form of the invention, shown in FIG. 4, the lining 13 may be fixed to the plastic device by means of a furring channel 15 or other stiffening means. The furring channel 15 would first be screw-fixed as at 16 to the plastic device, then the lining 13 fixed as at 17 to the furring channel as before.

The number and location of plastic fixing devices 6 and 10 would be such that all design loadings on the lining 13 would be transferred to the masonry wall 1. This would depend upon the type of lining material 13 (e.g., plywood or gypsum plaster), the location (e.g., living room or kitchen) and the type of fixing 14 of the lining material 13 (e.g., as the preferred form or the alternative using furring channels 15).

Fixings of the lining 13 at floor, ceiling, openings and wall-intersections may be independent of the plastic fixing device 6 and 10. Means of providing sufficient structural strength to the masonry skin 1 in certain conditions may also be independent of the plastic fixing device.

As previously described, the plastic fixing device 6 and 10 is secured to the masonry wall 1 in a dovetail groove 3 in the masonry units 2. The majority of masonry units 2 produced by industrialised processes are either cast or extruded. The inclusion of a dovetail groove 3 to those processes is simple and adds no cost. It provides a positive fixing for the device requiring minimum effort and skill.

In other forms according to the invention, the device may be screw-tapped to the masonry wall 1 or attached to ties bonded into the masonry work during construction. The dovetail groove may be made in the masonry unit 2 with a special tool after production instead of being incorporated in the manufacturing process. In a lesser preferred form, not shown, the device may be chemically bonded to the masonry wall. In each of these alternative forms it is apparent that either the fixing is weakened or the task of fixing is made more complex.

The plastic fixing device 6 and 10 is designed with a rectangular nose 7 that fits into the dovetail groove 3. Both the shape and the composition of the plastic enable a positive mechanical fixing to the masonry 1. The narrow dimension of rectilinear form fits into the groove 3. The elastic properties of the plastic enable the device 6 to deform as it is turned in the groove 3. The stored energy due to the elasticity ensures that, with the nosepiece 7 lengthwise in the groove 3, the device 6 is firmly retained.

The use of plastic for the device 6 in its preferred form has been selected for the elastic properties mentioned above, also for the simplicity, economy and precision of production, and its inert properties, compared with alternatives according to the invention. The degree of elasticity necessary for turning of the device 6 in the groove 3 and for tolerances in the dimensions of the groove 3 in the masonry unit 2, still enables a relatively rigid plastic to be used. Sufficient support is provided for the inner lining under design loading.

(Design loadings in the main are of a horizontal nature, either of pressure exerted on the lining 13 or impact loadings. Vertical loadings of the lining 13 itself and design loadings of fixtures on the lining 13 are supported through the lining 13, stiffened by the plastic fixing devices 6 and 10, and furring channels 15 in the alternative form, onto the floor).

A screw movement of the device 6 and 10 for aligning the inner lining material 13 is the preferred method of adjustment, because of its simplicity (ease of adjusting and precision of adjustment), its permanence (once the lining 13 is fixed to the device 10, no accidental or gradual movement is possible), and because successive turns of the screw-lip provide the dual purpose of adjustability and water-isolation.

The internal fixing surface is made large enough to allow for tolerances in the location of the groove 3 in the masonry wall 1 with respect to the desired location of the fixing of the lining 13. In an alternative form of the invention, the fixing surface 12 may be placed asymmetrically on the axis of the device 10. Within one cycle of the device, the tolerance of location of groove 3 vis-a-vis the location of the lining fixing 13 may be increased without affecting tolerances in the alignment of the inner lining 13.

What I claim is:

1. A method of constructing a cavity wall which includes a load-bearing masonry wall and a skin spaced from and defining a gap with said masonry wall, said method comprising the steps of:

a. erecting said masonry wall from masonry units provided with slots, said slots facing the site of said skin;

b. rigidly securing spacing devices in said slots, each of said spacing devices comprising a threaded rod, an elastically deformable tongue on one end of the respective rod, and a cap in the region of the other end of the respective rod in threaded engagement therewith so as to be movable axially of the respective rod upon relative rotation of the respective cap and rod, said tongues being receivable in said slots and being dimensioned such that rotation of said tongues in said slots causes compression of said tongues and a resultant rigid connection between said masonry wall and said spacing devices, and said spacing devices being secured in said slots by inserting said tongues in the respective slots and thereafter rotating said tongues in said slots to compress said tongues, said caps having fixing surfaces for alignment of said skin, and said rods being constructed such that a threaded portion of each rod remains exposed in the region of said masonry wall when said fixing surfaces are aligned in a predetermined plane subsequent to securing said spacing devices in said slots whereby moisture which penetrates said masonry wall and flows along said rods is caused to drip into said gap between said masonry wall and said skin;

c. aligning said fixing surfaces in said predetermined plane subsequent to securing said spacing devices in said slots by rotating at least some of said caps relative to the respective rods; and d. connecting said skin with said fixing surfaces.

2. A method as defined in claim 1 wherein said tongues comprise plastic.

3. A method as defined in claim 1 wherein said slots are dovetail slots.

4. A method as defined in claim 1 wherein each of said spacing devices consists essentially of plastic and said skin is connected to said fixing surfaces by conventional techniques.

5. A method as defined in claim 1 further comprising the step of fixing linings to wall openings and junctions independently of the use of said spacing devices.

6. A cavity wall comprising:

a. a load-bearing masonry wall which is subdivided into a plurality of masonry units provided with slots, said slots being located on one side of said masonry wall;

b. a plurality of spacing devices rigidly held in said slots, each of said spacing devices comprising a threaded rod, an elastically deformable tongue on one end of the respective rod, and a cap in the region of the other end of the respective rod in threaded engagement therewith, said tongues being received in the respective slots under compression so as to be rigidly secured therein, and said caps having fixing surfaces which are spaced from said masonry wall and are aligned in a predetermined plane; and c. a skin connected with said fixing surfaces and defining a gap with said masonry wall, each of said rods having an exposed threaded portion in the region of said masonry wall so that moisture which penetrates said masonry wall and flows along said rods is caused to drip into said gap.

7. A wall as defined in claim 6 wherein said tongues comprise plastic.

8. A wall as defined in claim 6 wherein said slots are dovetail slots.

* * * * *